United States Patent [19]

Torres et al.

[11] 4,380,011

[45] Apr. 12, 1983

[54] LOOP ANTENNA ARRANGEMENT FOR INCLUSION IN A TELEVISION RECEIVER

[75] Inventors: Rafael Torres, Plainsboro; Oakley M. Woodward, Princeton, both of N.J.

[73] Assignee: RCA Corporation, New York, N.Y.

[21] Appl. No.: 210,249

[22] Filed: Nov. 25, 1980

[51] Int. Cl.[3] ..... H01Q 1/24

[52] U.S. Cl. ..... 343/702; 343/744

[58] Field of Search ..... 343/702, 722, 726, 740, 343/728, 744, 743, 745, 741, 876

[56] References Cited

U.S. PATENT DOCUMENTS

| | | | |
|---|---|---|---|
| 2,313,231 | 3/1943 | Forbes | 250/20 |
| 2,320,124 | 5/1943 | Fobes | 250/20 |
| 2,322,126 | 6/1943 | Grimditch | 343/702 |
| 2,327,485 | 8/1943 | Alford | 250/33 |
| 2,514,992 | 7/1950 | Edelsohn | 250/33 |
| 2,551,664 | 5/1951 | Galper | 250/33 |
| 3,441,935 | 4/1969 | Leitner | 343/744 |
| 3,623,110 | 11/1971 | Doi | 343/722 |
| 3,721,990 | 3/1973 | Gibson et al. | 343/726 |
| 3,761,933 | 9/1973 | Smalser | 343/740 |
| 3,906,506 | 9/1975 | Verma et al. | 343/702 |
| 3,918,063 | 11/1975 | Nakamichi et al. | 343/722 |
| 3,973,263 | 8/1976 | Green | 343/744 |
| 4,123,756 | 10/1978 | Nagata et al. | 343/702 |
| 4,338,606 | 7/1982 | Tada et al. | 343/744 |

FOREIGN PATENT DOCUMENTS

| | | |
|---|---|---|
| 490383 | 2/1937 | United Kingdom . |
| 581724 | 5/1941 | United Kingdom . |
| 1480829 | 7/1974 | United Kingdom . |

OTHER PUBLICATIONS

J. Gibson & R. Wilson, "The Mini-State-A Small Television Antenna", *RCA Engineer*, vol. 20, No. 5, Feb.--Mar. 1975, pp. 9-19.

Takeda, et al., "FM Multipath Distortion in Automobile Receivers Has Been Significantly Reduced by a New Antenna System," *IEEE* Transactions on Consumer Electronics, vol. CE-26, No. 3, Aug. 1980, pp. 263-269.

*Primary Examiner*—David K. Moore

*Attorney, Agent, or Firm*—E. M. Whitacre; P. J. Rasmussen; Clement A. Berard, Jr.

[57] ABSTRACT

A VHF television receiving antenna arrangement includes a cabinet having a loop of electrically conductive material disposed on its top, back and sides, preferrably on the inside surfaces thereof. A gap in the loop defines first and second feed terminals to which circuitry for tuning the loop connects. The loop is tuned thereby over at least a portion of the television frequency bands, responsive to a control voltage. Signals from the tuning circuitry are coupled to a television receiver tuner by a transmission line. Such loops can also have capacitors connected across tuning gaps for making the directional response of the loop more uniform at relatively lower frequencies (e.g. VHF channels 2-6) or switching diodes connected across control gaps for changing the directional response of the loop at relatively higher frequencies (e.g. VHF channels 7-13).

27 Claims, 6 Drawing Figures

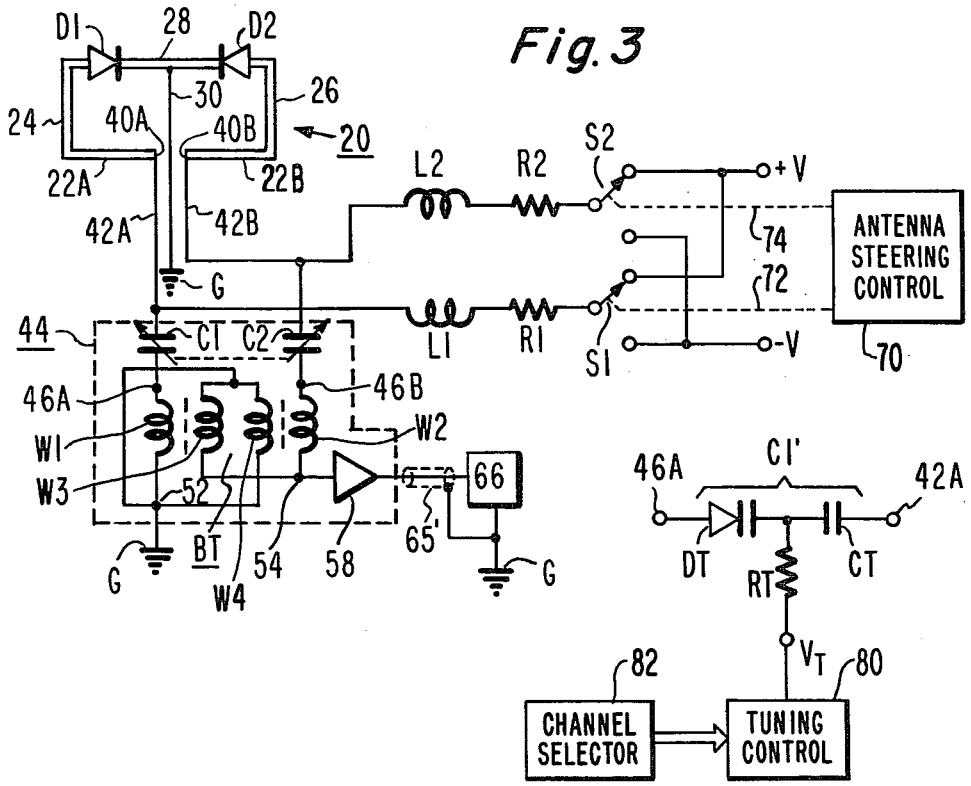
Fig. 3
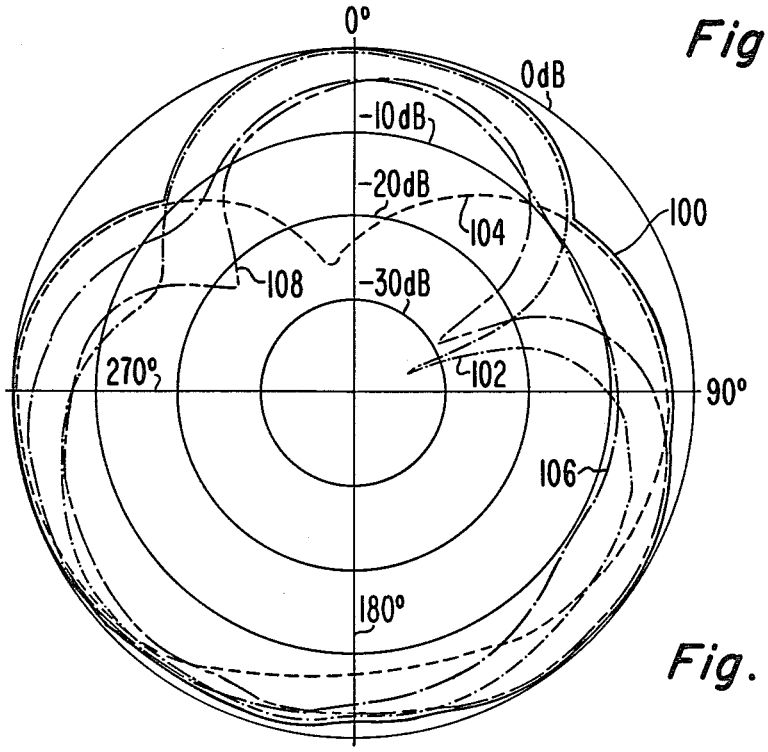
Fig. 4
Fig. 6

LOOP ANTENNA ARRANGEMENT FOR INCLUSION IN A TELEVISION RECEIVER

This invention relates to loop antenna arrangements and, in particular, to those suitable for inclusion within the cabinet of a television receiver.

Conventional television (TV) receivers employ monopole or dipole (i.e. "rabbit ears") antennas for receiving television signals in the lower (54–88 MHz) or upper (174–216 MHz) very high frequency (VHF) television bands. The lower band includes VHF channels 2–6 and the upper band includes VHF channels 7–13. While those arrangements provide acceptable quality of reception in locations near to the transmitting station, they are considered by some to be unsightly, difficult to adjust, and susceptible to damage through abuse. Thus, there exists a need for an antenna arrangement that can be included within the cabinet of a television receiver and which does not require adjustment by the viewer.

One arrangement for an in-set VHF TV antenna is described in U.S. patent application Ser. No. 210,251 entitled LOOP ANTENNA ARRANGEMENT FOR INCLUSION IN A TELEVISION RECEIVER, now U.S. Pat. No. 4,342,999, filed by O. M. Woodward and J. G. N. Henderson on even date herewith and assigned to the same assignee as is the present invention, and which is incorporated herein by reference. The present invention is directed to optimum arrangements for loop antennas of that type.

In the present antenna arrangement, a loop is formed from bands of electrically conductive material disposed along the top, first side, back, and second side surfaces of a cabinet for a television receiver. A gap in the loop defines first and second feed terminals to which tuning circuitry is coupled for tuning the loop over at least a portion of the television frequency band responsive to a control potential. The tuning circuitry is desirably mounted on the cabinet near to the feed terminals, and signals from the tuning circuitry are coupled to the tuner of the television receiver by a transmission line.

IN THE FIGURES:

FIGS. 3 and 4 are electrical schematic diagrams partially in block form of circuitry useful with the present invention;

FIG. 6 shows reception patterns for the arrangement of FIG. 1.

Figure 1:
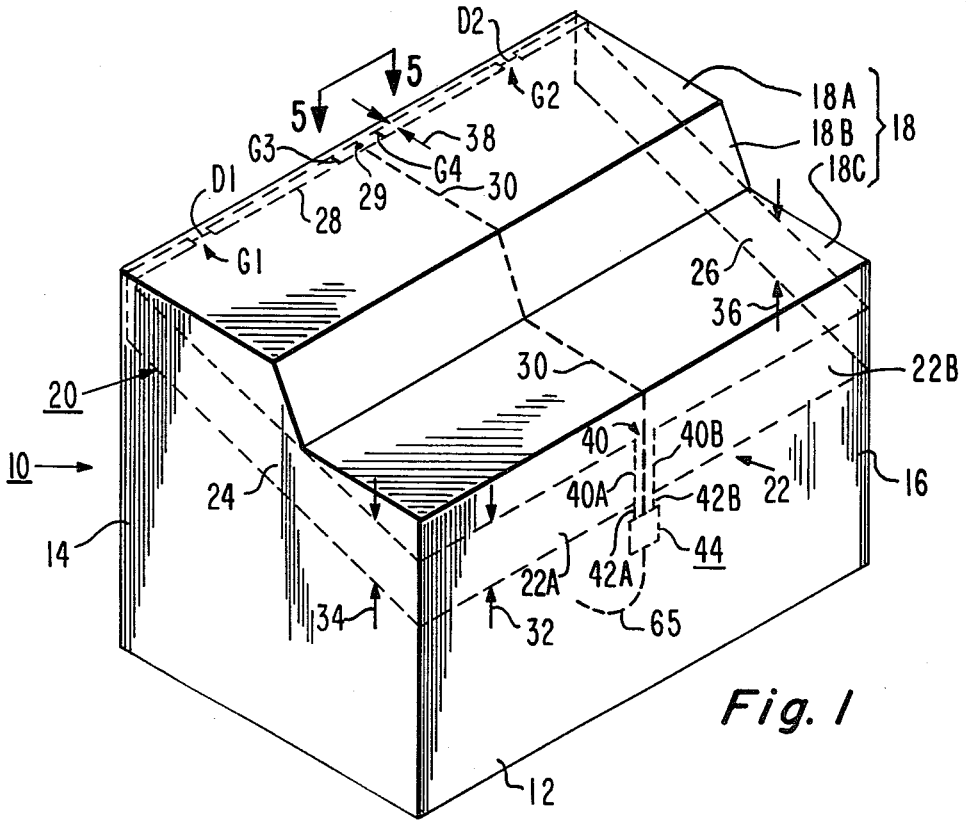
FIGS. 1 and 2 show embodiments of antenna arrangements according to the present invention in the cabinet of a television receiver.

In FIG. 1, cabinet 10 of a TV receiver has a substantially vertical back 12, substantially vertical opposing sides 14 and 16, and a top 18 substantially horizontally disposed between sides 14 and 16. Top 18 is, for example, comprised of panels 18A, 18B and 18C generally descending in level towards back 12 for the aesthetic purpose of creating the impression of reduced cabinet depth. Loop antenna arrangement 20 comprises a loop of electrically conductive material affixed to the inside surfaces of cabinet 10 Band 22 is substantially horizontally disposed on back 12 between sides 14 and 16, band 28 is disposed along top 18 between sides 14 and 16, band 24 is disposed on side 14 for connecting band 22 to band 28, and band 26 is disposed on side 16 for connecting band 22 to band 28. Band 22 is divided by gap 40 into portions 22A and 22B with feed terminals 40A and 40B being defined by the edges of gap 40.

Feed terminals 40A and 40B are respectively connected by conductors 42A and 42B to tuning circuitry 44 mounted, for example, on back 12. Signals from tuning circuitry 44 are coupled by transmission line 65 to the tuner (not shown) of the TV receiver. The cooperation between loop 20, tuning circuitry 44 and line 65 to the tuner is described in greater detail in the aforementioned Application of Woodward, et al., incorporated herein by reference for that purpose.

Loop 20 is suitably constructed, for example, of two-inch-wide thin copper strip for bands 22, 24 and 26 and of one-half-inch-wide thin copper strip for band 28. In practicing the invention, those thin copper bands may be glued or otherwise affixed to the inside surfaces of cabinet 10 so that its outside appearance is unaffected.

Figure 2:
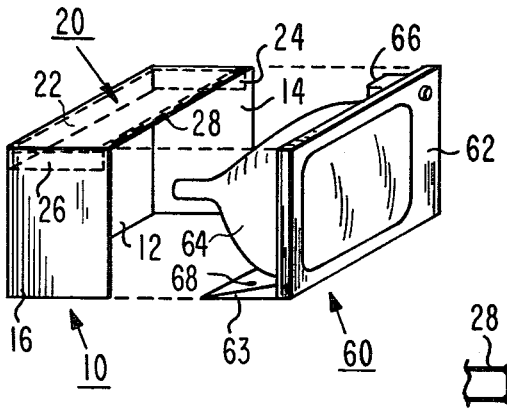

The difficulties and problems overcome by antenna arrangement 20 just described, and to be described in greater detail below, will be more fully appreciated by the consideration of TV receiver 60 in FIG. 2. Receiver 60 includes, in a front portion thereof, a front panel 62 and a base 63 which conventionally supports receiver 60. For example, kinescope 64 could be mounted to front panel 62 as is tuner 66. Chassis 68 including, for example, the remaining electrical circuits of TV receiver 60 could be mounted, for example, to base 63. Cabinet 10, shown removed from front 62 and base 63, includes antenna arrangement 20 described above.

Because incoming TV signals are horizontally polarized, it is desirable, from the electrical performance standpoints of developing the maximum received signal strength and exhibiting uniform response irrespective of the direction from which such signals are received, that loop 20 enclose the largest possible area in a horizontal plane. As can be appreciated from FIG. 2, to achieve that end directly would require that loop 20 include a band traversing the upper portion of front 62 above kinescope 64 and making electrical connections to side bands 24 and 26 when cabinet 10 is assembled to receiver 60. Thus two electrical contacts would be necessary to complete an electrical loop. Such contacts, in addition to their complexity and cost, suffer from susceptibility to damage and contamination which would degrade the quality of the electrical connections. Maintaining high quality electrical connections is particularly important where high frequency signals, such as those at VHF television frequencies, are to be conducted. A further disadvantage to such loop arrangement is that the upper portion of front panel 62 would be increased in size to accommodate the width of such electrical band. That increase could be detrimental to the styling and aesthetic appeal of TV receiver 60. The antenna arrangement of the present invention overcomes all of these problems and disadvantages as will now be explained.

Loop arrangement 20 of FIG. 1 obviates the need for electrical connections to front panel 62 and the aesthetic disadvantage thereof by disposing band 28 on top 18 along its front edge, i.e. the edge distal from back 12. In that manner loop 20 encloses substantially the largest possible area obtained by a loop on cabinet 10 without encountering the aforementioned problems and disadvantages.

Increasing the width of the bands increases the radiation resistance of the antenna which beneficially increases its efficiency as is described by J. J. Gibson and R. M. Wilson in "The Mini-State—A Small Television Antenna", *RCA Engineer*, Volume 20, No. 5, February-March, 1975, page 12. Empirical results show that a width of about two inches is satisfactory for reception of TV signals in the lower and upper VHF frequency bands. Further increases in width have been found to produce proportionally less significant increases in radiation resistance. Bands 22, 24, and 26 have respective widths 32, 34, and 36 in a vertical direction. The present inventors have found that width 38 of horizontally disposed top band 28 may be less than that of bands 22, 24 and 26 so that loop 20 encloses greater area without unacceptably reducing the received signal developed so as to degrade the quality of TV reception.

In-cabinet TV receiving antenna arrangements desirably exhibit an omni-directional reception pattern in the horizontal plane, i.e., the response to impinging TV signals should be more or less uniform irrespective of the horizontal direction from which such signals are received. In other words, the viewer should be able to locate the television set and obtain satisfactory reception without having to consider the location of the transmitting television station. Antenna arrangements of the present invention include features directed towards that end for signals in the lower and upper VHF television frequency bands.

In FIG. 1, band 28 of loop 20 includes direction-control gaps G1 and G2 directed the end of obtaining satisfactory reception in the upper VHF-TV band irrespective of the orientation of the television receiver with respect to the horizontal direction from which signals are received. Cabinet 10 is typically on the order of 12–20 inches dimension from front to back and of 22–30 inches dimension from side to side. Where $\lambda$ is the wavelength of the TV signal, the loop dimensions are approximately $\lambda/2$ to $\lambda/3$ in the upper VHF-TV band and less than about $\lambda/5$ in the lower VHF-TV band. Thus, the dimensions of loop 20 are less electrically small as compared to the wavelength $\lambda$ of television signals in the upper VHF-TV band. Further, the presence of conductive objects, such as chassis 68 for example, can disturb the fields associated with such signals in the vicinity of loop 20. As a result, the reception response pattern of loop 20 in the horizontal plane can tend to become somewhat directional.

That directionality can be modified responsive to the conduction and nonconduction of diodes D1 and D2 connected across control gaps G1 and G2, respectively. In one desirable arrangement, control gaps G1 and G2 are symmetrically disposed in relation to a point 29 on band 28 equidistant from sides 14 and 16. The present inventors have found that gaps G1 and G2 are satisfactorily located approximately 4 inches from side surfaces 14 and 16, respectively.

Diodes D1 and D2 are desirably switching diodes such as type HP5082-3188 P-I-N diodes manufactured by Hewlett-Packard. P-I-N diodes are desirably employed because they exhibit low impedance when forward biased and exhibit low capacitance when reverse biased so that their reverse impedance is relatively high at VHF television frequencies. Diodes D1 and D2 serve as switches that selectively make a conductive path across control gaps G1 and G2 to selectively modify the configuration of loop 20 to produce selective reception patterns of varying directionality. Means by which D1 and D2 are rendered conductive and non-conductive are described below in relation to FIG. 3.

Biasing connections to first ones of the anode or cathode electrodes of diodes D1 and D2 are provided by conductor 30 disposed on top 18. Conductor 30 connects to band 28 at point 29 substantially equidistant from side surfaces 14 and 16. Where gap 40 is located on band 22 substantially equidistant from sides 14 and 16, the potential at the center of gap 40 is substantially the same as that at point 29. As a result, the potentials at points along conductor 30 can be the same as that at point 29 and gap 40 so the degree to which conductor 30 tends to interfere with the uniformity of the reception pattern of loop 20 is minimized. Biasing connections to the other electrodes of D1 and D2 are explained below with reference to FIG. 3.

FIG. 3 shows by way of example circuit connections between loop 20, tuning circuitry 44, and tuner 66, as well as means for applying biasing potentials to diodes D1 and D2.

Antenna steering control 70 responds to a horizontal direction from which VHF-TV signals are received to control switches S1 and S2 via means 72 and 74, respectively. Thus, diodes D1 and D2 are rendered appropriately conductive and non-conductive so that the configuration of loop 20 is that from which the highest strength TV signals are developed. One such means for automatically steering the reception pattern of the antenna loop 20 is described in related U.S. patent application Ser. No. 210,248 entitled APPARATUS FOR AUTOMATICALLY STEERING AN ELECTRICALLY STEERABLE TELEVISION ANTENNA, now U.S. Pat. No. 4,349,840, filed by J. G. N. Henderson on even date herewith and assigned to the same assignee as is the present invention, is incorporated herein by reference.

The cathodes of D1 and D2 connect together via band 28 and thence to ground G via conductor 30. The anode of D1 connects to tuning circuitry 44 via bands 24, 22A and connection 42A. Similarly, diode D2 anode connects to tuning circuitry 44 via bands 26, 22B and connection 42B. Although it is of little moment which polarity direction is selected for D1 and D2, it is believed more convenient to arrange D1 and D2 with their cathodes connected to conductor 30 where greater flow for forward biasing is available from a source of positive direct potential.

Forward biasing direct potential $+V$ and reverse biasing direct potential $-V$ are applied to diodes D1 and D2 through switches S1 and S2, respectively. Resistors R1 and R2 are of values selected to determine the magnitude of forward-biasing current in D1 and D2, respectively. Inductors L1 and L2 present low impedance to the direct-current potentials $+V$ and $-V$ but present high impedance at VHF-TV frequencies so that VHF-TV signals from loop 20 are directed to tuning circuitry 44.

Tuning circuitry 44, shown by way of example, receives via connections 42A and 42B the balanced input signals developed at feed terminals 40A and 40B of loop 20 responsive to television signals impinging upon loop 20. Those balanced signals are applied at the respective first plates of variable capacitors C1 and C2. Capacitors C1 and C2 can be varied cooperatively, as is indicated by the phantom line between the respective arrows indicating their variable nature, so as to maintain balance at the inputs to tuning circuitry 44. Signals at input connections 46A and 46B are applied to windings W1 and W2 of transformer (balun) BT. Windings W3 and W4 of balun BT are connected so the balanced signals at 46A and 46B are transformed to a single-ended (unbalanced) signal between output connections 52 and 54.

Because those signals are single-ended, connection 52 is connected to ground G and signals at connection 54 are applied to the input connection of amplifier 58. Signals at the output connection of amplifier 58 are coupled to tuner 66 by transmission line 65, shown by way of example as coaxial cable 65'.

As discussed above, loop 20 is more electrically small as compared to the wave length of received signals in the lower portion of the VHF-TV frequency band and is less electrically small for signals in the upper VHF television bands. It is noted that while the bandwidth of a television channel, about 6 MHz, is the same for channels 2–13, the required bandwidth is a much smaller proportion of the carrier frequency for the higher-numbered channels. As a result, tuning circuitry 44 need only be turned by capacitors C1 and C2, for example, when signals in the lower VHF-TV band are to be received and need not be tuned when signals in the upper portion thereof are to be received.

To that end, tuning control 80 of FIG. 4 applies control potential $V_T$ to capacitance network C1' responsive to channel selector 82. Selector 82 operates to generate channel indications responsive to viewer selection inputs. Capacitor network C1' is of a type that can be employed as either of capacitors C1 or C2 in FIG. 3. C1' includes variable capacitance diode DT serially connected with DC blocking capacitor CT. The capacitance of diode DT is variable responsive to the voltage between its anode and cathode electrodes. Specifically, the capacitance of DT responds to control potential $V_T$ applied to its cathode through resistor RT. Resistor RT is of sufficiently low impedance, e.g. 100 kilohoms, to pass control potential $V_T$ to the cathode of capacitance diode DT while presenting a relatively high impedance compared to that of the series path through CT and DT at VHF-TV frequencies so that signals thereat are directed through the series path CT, DT. Capacitor CT blocks the direct potential $V_T$ from affecting the potential at connection 42A which is used to select conduction and nonconduction in switch diode D1. CT also blocks the potential at connection 42A from affecting the capacitance exhibited by diode DT. When tuning is not needed, $V_T$ is generated of opposite polarity so as to forward bias variable capacitance diode causing it to exhibit a comparatively low impedance.

Specific embodiments of suitable tuning circuitry 44 are described in U.S. patent application Ser. No. 210,247 entitled AUTOMATIC TUNING CIRCUIT ARRANGEMENT WITH SWITCHED IMPEDANCES, now U.S. Pat. No. 4,339,827, filed by R. Torres and J. G. N. Henderson on even date herewith and assigned the same assignee as is the present invention, and which is incorporated herein by reference. That application discusses in greater detail how tuning control 80 generates potential $V_T$ for each channel in the lower and upper VHF-TV frequency bands.

Figure 5:
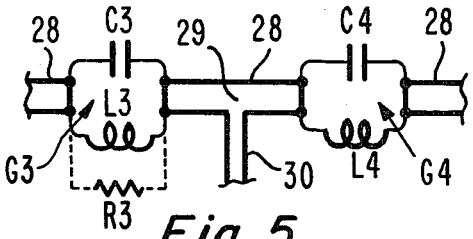
FIG. 5 shows a detail of the arrangement of FIG. 1.

A further feature of loop 20, directed towards achieving a more uniform reception pattern in the lower VHF-TV frequency band is shown in FIG. 5. Band 28 has tuning gaps G3 and G4 desirably located relatively close to and equidistant from the interconnection of band 28 and conductor 30 at point 29. Tuning gaps G3 and G4 each have a capacitance C3 and C4, respectively, connected thereacross so that a more uniform current distribution within the loop obtains tending to make the reception pattern more uniform. With gaps G3 and G4 each located approximately one inch from point 29, capacitances of C3 and C4 in the range of 2–10 picofarads have been found satisfactory to obtain a more uniform reception pattern in the horizontal plane for VHF-TV channels 2–6. When gaps G3 and G4 are located more remotely from point 29, the required value of capacitances C3 and C4 increases. The present inventors have found that capacitances C3 and C4 also aid tuning circuitry 44 in tuning loop 20 to receive VHF-TV channel 2. Capacitances of approximately 6.8 picofarads for C3 and C4 were satisfactory when gaps G3 and G4 were approximately one inch from point 29.

When the G3, G4 tuning gap arrangement of FIG. 5 is used in conjunction with the antenna pattern steering arrangement (including diodes D1 and D2) of FIGS. 1 and 3, direct-coupled connections are required between the cathode electrodes of D1 and D2 and conductor 30. That DC path completes a connection for carrying direct control potentials to D1 and D2. Such direct-coupled impedance connections are shown by way of example as inductances L3 and L4 connected in parallel with the capacitances C3 and C4, respectively. Resistance R3, shown in phantom, could be connected in parallel with capacitance C3 in an alternative embodiment.

The radiation reception pattern of the antenna arrangement 20, with experimentally determined locations for gaps G1–G4 described above with respect to FIGS. 1 and 5, is shown in the polar plot of FIG. 6. The axes labelled 0° and 180° correspond to the horizontal directions to which the front 62 and back 12 of TV receiver 60, respectively, face. Likewise, the axes labelled 90° and 270° correspond to the directions to which sides 14 and 16, respectively, face. Relative strength of the received TV signal in decibels (dB) is indicated by the concentric circles labelled 0 dB, −10 dB and so forth. Patterns 100–108 are shown by way of example as representative measured patterns near the center of the upper VHF-TV frequency band, i.e. at 195 MHz.

Pattern 102 obtains when switch diodes D1 and D2 of antenna 20 are both rendered conductive and is thus the same pattern as would obtain absent G1, G2, D1 and D2. Large conductive members, for example, kinescope 64, chassis 68 and tuner 66, in TV receiver 60 proximate to antenna 20, contribute to causing pattern 102 to depart from an ideal circular shape. For pattern 102 that departure is particularly severe at about 70° and 300° directions.

But the switching of diodes D1 and D2 to conduction and nonconduction alters the current distribution around loop 20 consequently affecting its radiation pattern. With both D1 and D2 nonconductive, pattern 104 obtains. With only D1 conductive, pattern 106 obtains, and with only D2 conductive, pattern 108 obtains. Composite pattern 100 obtains when diodes D1 and D2 are selectively rendered conductive responsive to the horizontal direction from which TV signals are received whereby the pattern most nearly approaching the 0 dB circle is selected. Thus, the radiation reception pattern of antenna 20 becomes more uniform or circular as a result of selectively switching D1 and D2 across gaps G1 and G2, respectively. From FIG. 6, it appears satisfactory that only the two conditions—both D1 and D2 conductive, or both D1 and D2 nonconductive—are employed to obtain pattern 100, in this instance.

Modifications of the specific embodiments discussed with reference to FIGS. 1–5 are contemplated to be within the scope of the present invention as defined by the following claims.

For example, gap 40 may be located on loop 20 elsewhere than on band 22 on back surface 12. In addition, such loops are not limited to a single gap such as 40 defining feed terminals. Other antenna arrangements having differing numbers of control gaps and tuning gaps from the arrangement specifically described herein may also be satisfactorily employed. In a loop having two feed gaps and sets of feed terminals, two control gaps were employed. The feed gaps were located near the centers of front band 28 and back band 22, and the control gaps were located near the centers of side bands 24 and 26, respectively.

Furthermore, it is satisfactory that alternative means for applying control potentials to the switched diodes D1 and D2, and that different tuning circuitry be employed. For example, means such as those described in the U.S. Pat. Nos. 4,339,827 and 4,342,999 referred to hereinabove can be employed in conjunction with the antenna arrangements of the present invention. Also, where diode DT of FIG. 4 is to be forward biased as discussed above, it is satisfactory for RT to be of lower resistance and in series connection with an inductance.

What is claimed is:

1. An antenna arrangement for inclusion within a television receiver having a tuner, and responsive to signals in selected frequency bands comprising:

a cabinet for said television receiver having at least two opposing substantially vertical side surfaces and a substantially vertical back surface therebetween, and having a top surface substantially horizontally disposed between said side side surfaces;

a substantially horizontal loop formed of a band of electrically conductive material having a gap defining first and second feed terminals, which loop includes a first portion of said band of electrically conductive material affixed along said top surface between said side surfaces, a second portion of said band of electrically conductive material substantially horizontally affixed along said back surface between said side surfaces, a third band portion of said of electrically conductive material affixed along one of said side surfaces for connecting one end of said first portion of said band to one end of said second portion of said band, a fourth portion of said band of electrically conductive material affixed along the other of said side surfaces for connecting an other end of said first portion of said band to an other end of said second portion of said band, and said second, third and fourth portions of said band each having a respective width dimension greater than that of said first portion of said band, whereby the width dimension of said first portion of said band lies in a substantially horizontal plane and the width dimensions of said second, third and fourth portions of said band lie in substantially vertical planes;

tuning circuitry coupled to said first and second feed terminals for tuning said loop over at least a portion of said frequency bands responsive to a control potential, said tuning circuitry being affixed to said cabinet proximate said first and second feed terminals; and a transmission line for coupling said tuning circuitry to the tuner of said television receiver.

2. The antenna arrangement of claim 1 wherein said loop has at least one tuning gap, said loop further including capacitance means of same number as said tuning gaps, each said capacitance means being connected across the tuning gap associated therewith.

3. The antenna arrangement of claim 2 further including impedance means of same number as said capacitance means, each said impedance means being parallely connected with its associated capacitance means for providing a direct-coupled connection thereacross.

4. The arrangement of claim 3 wherein said impedance means is an inductance.

5. The arrangement of claim 3 wherein said impedance means is a resistance.

6. The antenna arrangement of claim 2 wherein said gap defining said first and second feed terminals is located on said second portion of said band substantially equidistant from said side surfaces, and wherein first and second ones of said tuning gaps are located on said first portion of said band symmetrically disposed with respect to a point thereon substantially equidistant from said side surfaces.

7. The antenna arrangement of claim 6 wherein said first and second tuning gaps are proximate said equidistant point on said first portion of said band.

8. In the antenna arrangement of claim 2, 6 or 7 wherein said selected frequency bands are television frequency bands having upper and lower portions, and wherein the response of said antenna arrangement to signals in said lower portion is nonuniform with respect to horizontal directions from which said signals are received, said capacitance means having a value selected for making the response to signals in said lower portion more uniform.

9. The antenna arrangement of claim 8 wherein the value of said capacitance means is further selected for cooperating with said tuning circuitry to tune said loop at a lowest channel frequency within the lower portion of said television frequency bands.

10. The antenna arrangement of claim 1 wherein said loop has at least one direction-control gap, said arrangement further including switch means of same number as said direction-control gaps, each said switch means being connected across its associated direction-control gap for selectively making a conductive path thereacross.

11. The antenna arrangement of claim 10 wherein said switch means includes diode means having anode and cathode electrodes respectively connected to opposite ends of said associated direction-control gap, and means for applying a potential between the anode and cathode electrodes of said diode means, which potential is of a first polarity for rendering said diode means conductive and of a second and opposite polarity for rendering said diode means nonconductive.

12. The antenna arrangement of claims 10 or 11 wherein said gap defining first and second feed terminals is located on said second portion of said band substantially equidistant from said side surfaces, and wherein first and second ones of said direction-control gaps are located on said first portion of said band symmetrically disposed with respect to a point thereon substantially equidistant from said side surfaces.

13. The antenna arrangement of claim 12 wherein said means for applying a potential includes:

a source of direct potentials of said first and second polarities with respect to a point of reference potential, a conductor connected between said equidistant point on said first portion of said band and said point of reference potential, first means for selectively connecting said source of direct potentials to said first feed terminal, and second means for selectively connecting said source of direct potentials to said second feed terminal.

14. The antenna arrangement of claim 13 wherein said conductor is disposed on said top surface substantially equidistant between said side surface.

15. In the antenna arrangement of claim 10 wherein said selected frequency bands are television frequency bands having lower and upper portions, means for rendering said switch means conductive when signals in the lower portion of said television frequency bands are to be received and for rendering said switch means selectively conductive and nonconductive when signals in the upper portion thereof are to be received.

16. The antenna arrangement of claim 15 wherein said means for rendering said switch means selectively conductive and nonconductive when signals in the upper portion of the television frequency bands are to be received is responsive to horizontal directions from which said signals are received.

17. The antenna arrangement of claim 1 wherein said tuning circuitry includes diode means for developing a capacitance between its first and second electrodes, the value of said capacitance being responsive to the reverse bias potential between said first and second electrodes, means coupling said first feed terminal to one of said first and second electrodes, and means for developing said control potential between said first and second electrodes.

18. In the antenna arrangement of claim 17 wherein said selected frequency bands are television frequency bands having lower and upper portions, the value of said control potential being selected for reverse biasing said diode means when signals in said lower portion are to be received and for forward biasing said diode means when signals in said upper portion are to be received.

19. An antenna arrangement for inclusion in a television receiver having a tuner, and responsive to signals in selected frequency bands comprising:

a substantially horizontal loop antenna formed of a band of electrically conductive material having a plurality of gaps therein, a first of said gaps defining first and second feed terminals;

coupling means for coupling each of said first and second feed terminals to the tuner of said television receiver;

switch means connected across at least a second of said gaps and located proximate thereto for selectively making a conductive connection thereacross to produce different directional reception patterns in response to a control signal, wherein said selectively conductive connection provides a low positive resistance connection; and control means including an electrically conductive path provided by said loop antenna for applying said control signal through said feed terminals and said loop antenna to said switch means to produce said different directional reception patterns.

20. The antenna arrangement of claim 19 wherein said switch means comprises switching diode means having anode and cathode electrodes respectively connected to opposite ends of said second gap for providing said selectively conductive connection having a low positive resistance, and wherein said control means comprises means for applying said control signal between the anode and cathode electrodes of said switching diode means, said control signal being of first polarity for rendering said switching diode means conductive to provide said low positive resistance connection and being of second polarity opposite to the first for rendering said switching diode means nonconductive.

21. The antenna arrangement of claim 19 wherein said coupling means includes a transmission line coupled to said tuner and circuitry for coupling said first and second feed terminals to said transmission line, said circuitry cooperating with said control means and said loop antenna for applying said control signal to said switch means.

22. The antenna arrangement of claim 21 wherein said circuitry for coupling includes a transformer means having first and second winding connections to which said first and second feed terminals are coupled, and having a third winding connection for coupling to said transmission line.

23. The antenna arrangement of claim 22 wherein said circuitry for coupling further includes a capacitance connected serially with said transformer means between said first and second feed terminals and said transmission line.

24. The antenna arrangement of claim 19 further comprising capacitance means connected across at least a third of said gaps.

25. The antenna arrangement of claim 24 further including impedance means of same number as said capacitance means, each said impedance means being parallelly connected with its associated capacitance means for providing a direct-coupled connection thereacross for conducting said control signal to said switch means.

26. The antenna arrangement of claim 25 wherein said impedance means includes an inductance.

27. An antenna arrangement for inclusion within a television receiver having a tuner, and responsive to signals in selected frequency bands comprising:

a cabinet for said television receiver having at least two opposing substantially vertical sides and a substantially vertical back therebetween, and having a top substantially horizontally disposed between said sides;

a substantially horizontal loop formed of a band of electrically conductive material having a gap defining first and second feed terminals, which loop includes a first portion of said band of electrically conductive material disposed along said top between said sides, said first band having a width dimension, a second portion of said band of electrically conductive material substantially horizontally disposed on said back between said sides, a third portion of said band of electrically conductive material disposed on one of said sides for connecting one end of said first portion of said band to one end of said second portion of said band, a fourth portion of said band of electrically conductive material disposed on the other of said sides for connecting an other end of said first portion of said band to an other end of said second portion of said band, and said second, third and fourth portion of said band each having a respective width dimension greater than that of said first portion of said band, whereby the width dimension of said first portion of said band lies in a substantially horizontal plane and the width dimensions of said second, third and fourth portions of said band lie in substantially vertical planes; and a transmission line for coupling said first and second feed terminals of said loop to the tuner of said television receiver.

* * * * *